US009634414B1

(12) United States Patent
Chen

(10) Patent No.: US 9,634,414 B1
(45) Date of Patent: Apr. 25, 2017

(54) SIMPLE FEMALE TERMINAL AND A SIMPLE LED LAMP CONNECTOR FOR A DRIVE BOARD AND A LIGHT BOARD

(71) Applicant: Bingshui Chen, Xiamen (CN)

(72) Inventor: Bingshui Chen, Xiamen (CN)

( * ) Notice: Subject to any disclaimer, the term of this patent is extended or adjusted under 35 U.S.C. 154(b) by 0 days.

(21) Appl. No.: 15/043,172

(22) Filed: Feb. 12, 2016

(51) Int. Cl.

| | |
|---|---|
| ***H01R 13/11*** | (2006.01) |
| ***H01R 33/00*** | (2006.01) |
| ***F21V 23/06*** | (2006.01) |
| ***F21K 99/00*** | (2016.01) |
| *F21Y 101/02* | (2006.01) |

(52) U.S. Cl.
CPC ..... *H01R 13/113* (2013.01); *F21K 9/1355* (2013.01); *F21V 23/06* (2013.01); *H01R 33/00* (2013.01); *F21Y 2101/02* (2013.01)

(58) Field of Classification Search
CPC ..... H01R 13/10; H01R 13/111; H01R 13/113; H01R 13/114; H01R 13/115; H01R 13/26; H01R 33/00; F21K 9/238; F21V 21/002; F21V 21/08; F21V 21/0832; F21V 23/006; F21V 23/06; F21Y 2101/00
See application file for complete search history.

(56) References Cited

U.S. PATENT DOCUMENTS

| | | | | |
|---|---|---|---|---|
| 5,083,947 | A * | 1/1992 | Dominique | H01R 4/489 439/268 |
| 5,902,142 | A * | 5/1999 | Kondo | H01R 12/79 439/267 |
| 8,550,838 | B2 * | 10/2013 | Osagle | H01R 4/4818 439/441 |
| 2011/0250775 | A1 * | 10/2011 | Bies | H01R 4/4836 439/296 |
| 2011/0250803 | A1 * | 10/2011 | Bies | H01R 4/4836 439/752.5 |
| 2014/0242833 | A1 * | 8/2014 | Mostoller | H01R 4/4836 439/438 |

* cited by examiner

*Primary Examiner* — Hargobind S Sawhney

(57) ABSTRACT

A simple female terminal includes a mounting base, a weld leg, and an elastic plate. One end of the mounting base bends to form the weld leg. Another end of the mounting base bends to form the elastic plate. A head of the elastic plate bends toward the mounting base to form a contact head. While a male terminal comes into contact with the elastic plate, the contact head is pushed by the male terminal so that the contact head can rest against the mounting base. A connector and an LED lamp adapted to the simple female terminal are also disclosed. The structure of the female terminal is simplified, so the structure of the connector and the LED lamp are also simplified to obtain an easy installation and reduce the cost.

7 Claims, 4 Drawing Sheets

SIMPLE FEMALE TERMINAL AND A SIMPLE LED LAMP CONNECTOR FOR A DRIVE BOARD AND A LIGHT BOARD

BACKGROUND OF THE INVENTION

1. Field of the Invention

This invention relates to a power connecting technique of an LED lamp and relates particularly to a simple female terminal, a simple LED lamp connector for a drive board and a light board adapted to the female terminal, and an LED lamp adapted to the connector.

2. Description of the Related Art

In recent technique, in order to achieve the convenience of the connection between a drive board and a light board of an LED lamp, female terminals and a female housing are disposed on the light board and male terminals are disposed on the drive board. The male terminals penetrate through the female housing to be contact with the female terminals, thereby attaining an electrical connection between the drive board and the light board. However, the male terminals must be held by two elastic plates, no matter whether the present female terminal is a positive female terminal or a negative female terminal. This situation causes the female terminals to have a complex structure and also causes a complicated installation and a higher cost.

SUMMARY OF THE INVENTION

The main object of this invention is to provide a simple female terminal to simplify the structure of the female terminal, obtain an easy installation, and reduce the cost.

Another object of this invention is to provide a simple LED lamp connector for a drive board and a light board adapted to the simple female terminal.

The other object of this invention is to provide an LED lamp adapted to the connector.

To achieve above objects, the solution of this invention is as below:

A simple female terminal includes a mounting base, a weld leg, and an elastic plate. One end of the mounting base bends to form the weld leg. Another end of the mounting base bends to form the elastic plate. A head of the elastic plate bends toward the mounting base to form a contact head. When a male terminal and the elastic plate come into contact together, the male terminal pushes the contact head to allow the contact head to rest against the mounting base.

Preferably, the mounting base has a horizontal plate and a vertical plate. One end of the horizontal plate bends inclinedly and downwards and further bends horizontally to form the weld leg. Another end of the horizontal plate connects with an upper end of the vertical plate. A lower end of the vertical plate bends inclinedly and upwards and further bends toward the vertical plate to form a contact head which is in an arched shape.

A simple LED lamp connector for a drive board and a light board is also disclosed. The simple LED lamp includes at least one simple female terminal, a female housing, and at least one male terminal.

The female housing is installed on the light board and provided with at least one chamber. A bottom of the chamber forms a male terminal entrance. The simple female terminal is installed on the female housing. The simple female terminal has a mounting base disposed at a side wall of the chamber, a weld leg located out of the chamber to connect with the light board, and an elastic plate located in the chamber. A head of the elastic plate is located above the male terminal entrance. The elastic plate and another side wall of the chamber are constructed as a holding portion. The male terminal is installed on and connected to a drive board. The male terminal penetrates through the male terminal entrance and inserts into the holding portion to come into contact with the elastic plate. Meanwhile, the male terminal presses a contact head to allow the contact head to rest against the mounting base.

Preferably, a barb is formed on a side of the mounting base to provide an engagement with the side wall of the chamber.

Preferably, the female terminal is divided into a positive female terminal and a negative female terminal. The male terminal is divided into a positive male terminal and a negative male terminal. The female housing forms two chambers where the positive female terminal and the negative female terminal are installed. A baffle plate is formed between the chambers. The positive male terminal and the negative male terminal are respectively inserted into the chambers. One side of the positive male terminal and one side of the negative male terminal are in contact with the elastic plate respectively, and another side of the positive male terminal and another side of the negative male terminal are in contact with sides of the baffle plate.

Preferably, the male terminal is equipped with a male housing. The male housing is installed on the drive board. The male terminal penetrates through the male housing. One end of the male terminal is connected to the drive board. Another end of the male terminal penetrates through the male terminal entrance to contact with the elastic plate.

An LED lamp is also disclosed. The LED lamp includes a lamp cap, a light board, a drive board, a lamp holder, and a lamp base. The lamp cap is installed on the lamp holder. The light board is installed in the lamp cap. The drive board is installed in the lamp holder. The light board is located above the drive board. The lamp base is installed on the lamp holder. The simple LED lamp connector for the drive board and the light board is installed between the light board and the drive board. The LED lamp connector has a female housing installed through a through hole of the light board and at least one simple female terminal installed in the female housing. The simple female terminal has a weld leg electrically connected to the light board. A male terminal is installed on the drive board. Owing to the male terminal which passes through a male terminal entrance of the female housing to contact with the elastic plate, an electrical connection between the light board and the drive board is achieved.

With the above programs, the female terminal of this invention only has one elastic plate to be pressed by the male terminal. Another side of the male terminal rests against the female housing, and the contact head of the elastic plate is pressed to rest against the mounting base, thereby enhancing the normal force of the contact head of the elastic plate and the male terminal to provide the stable contact. The female terminal, the connector, and the LED lamp of this invention include the simplified structure, the easy installation, and the lower cost.

DETAILED DESCRIPTION OF THE PREFERRED EMBODIMENTS

Figure 1:
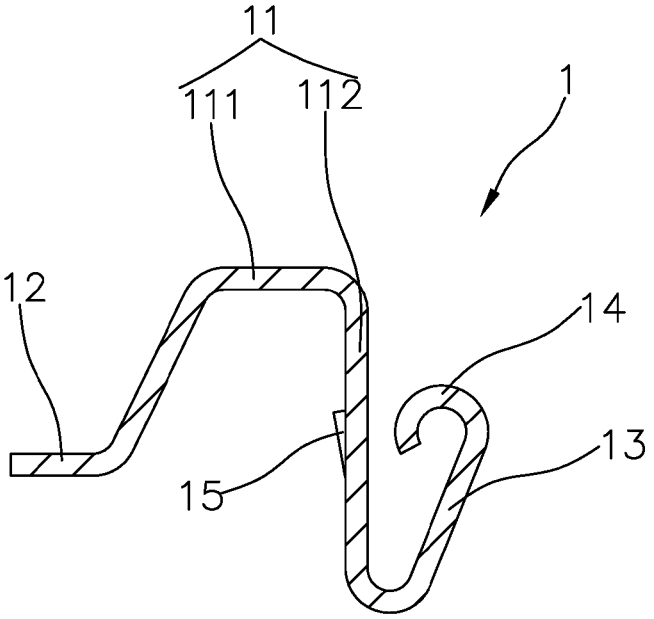
FIG. 1 is a schematic view showing a simple female terminal of this invention.
Figure 2:
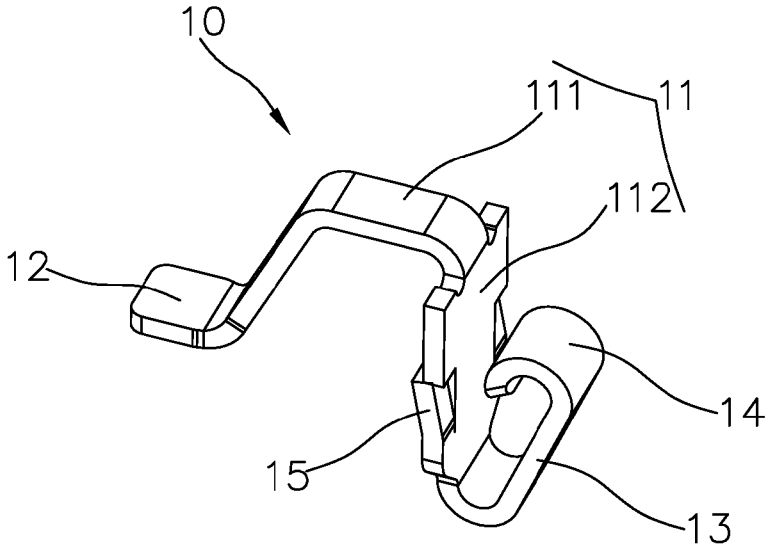
FIG. 2 is a side elevational view showing the simple female terminal of this invention.
Figure 3:
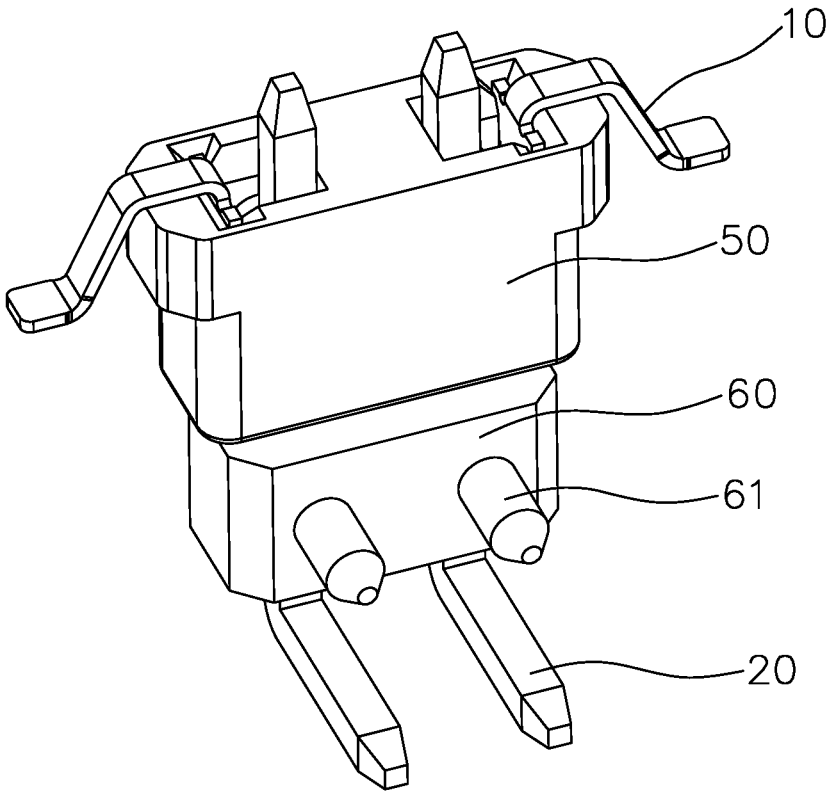
FIG. 3 is a combined schematic view showing an entire connector of this invention.
Figure 4:
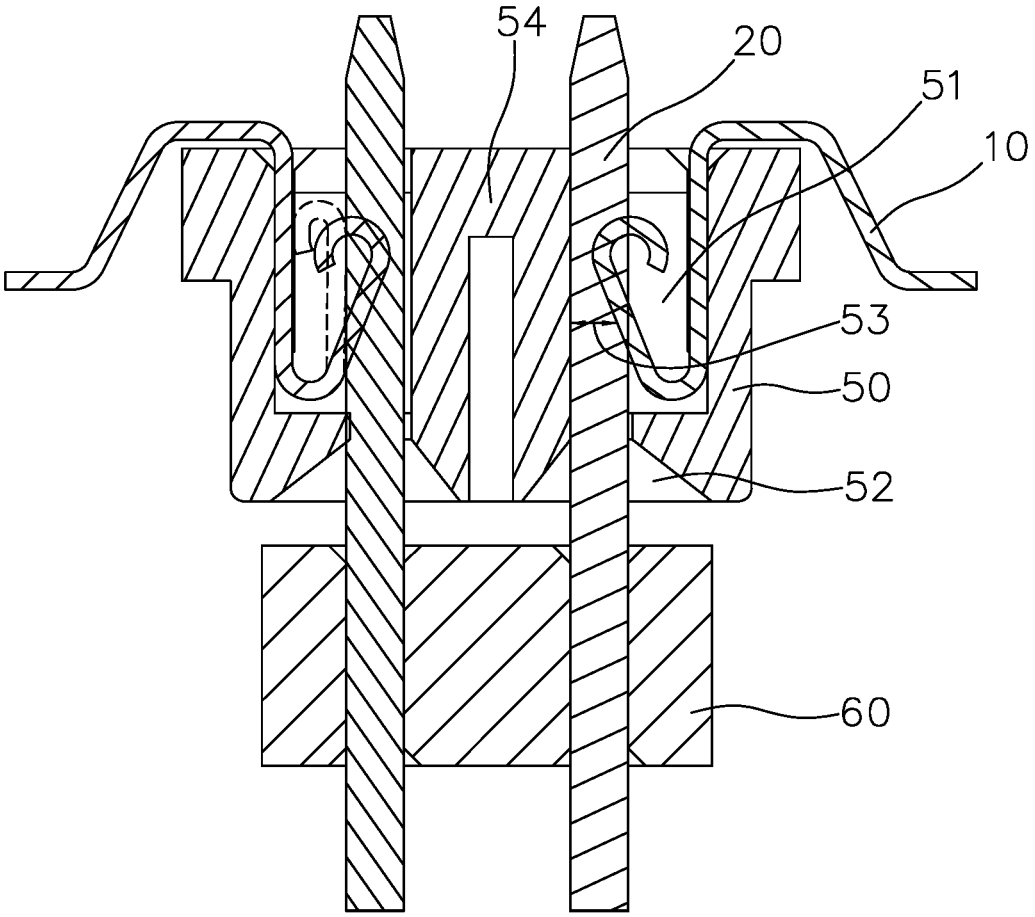
FIG. 4 is a cross-sectional view showing the connector of this invention.
Figure 5:
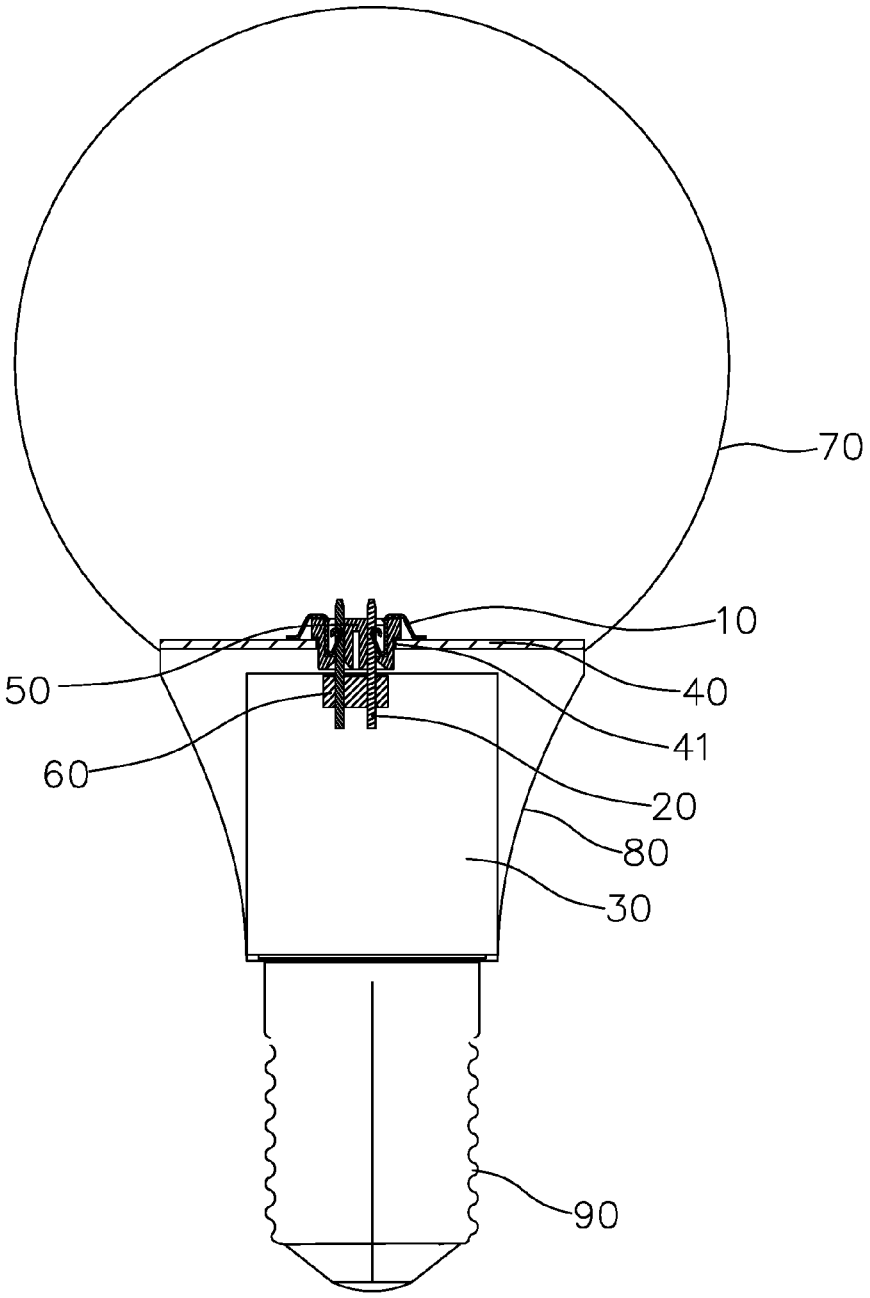
FIG. 5 is a cross-sectional view showing an LED lamp equipped with the entire connector of this invention.

Referring to FIG. 1 to FIG. 5, a simple female terminal 10 disclosed in this invention has a mounting base 11, a weld leg 12, and an elastic plate 13. One end of the mounting base 11 bends to form the weld leg 12. Another end of the mounting base 11 bends to form the elastic plate 13. A head of the elastic plate 13 bends toward the mounting base 11 to form a contact head 14. When a male terminal 20 contacts with the elastic plate 13, the male terminal 20 presses the contact head 14 to allow the contact head 14 to rest against the mounting base 11. Hence, the normal force of the contact head 14 of the elastic plate 13 and the male terminal 20 is increased to provide the stable contact between the simple female terminal 10 and the male terminal 20. Meanwhile, only one elastic plate 13 is provided to be pressed and contacted by the male terminal 20. Therefore, the structure is simplified, the installation is easier, and the cost is reduced.

The simple female terminal 10 can be formed directly by a sheet-metal forming process. Specifically, the mounting base 11 has a horizontal plate 111 and a vertical plate 112. One end of the horizontal plate 111 bends inclinedly and downwards and further bends horizontally to form the weld leg 12. Another end of the horizontal plate 111 connects with an upper end of the vertical plate 112. A lower end of the vertical plate 112 bends inclinedly and upwards and further bends toward the vertical plate 112 to form the contact head 14 which is in an arched shape.

The simple female terminal 10 of this invention is applied to the connection between the drive board 30 and the light board 40 of the LED lamp to construct the simple LED lamp connector for the drive board and the light board. The simple LED lamp connector for the drive board and the light board includes at least one simple female terminal 10, a female housing 50, and at least one male terminal 20. The female housing 50 is installed on the light board 40 and provided with at least one chamber 51. A bottom of the chamber 51 forms a male terminal entrance 52. The simple female terminal 10 is installed on the female housing 50. The simple female terminal 10 has a mounting base 11 disposed at a side wall of the chamber 51. A barb 15 is formed on a side of the mounting base 11 to provide an engagement with the side wall of the chamber 51. This disposition reinforces the installation between the simple female terminal 10 and the female housing 50 to be more stable. The simple female terminal 10 further has a weld leg 12 located out of the chamber 51 to connect with the light board 40 electrically and an elastic plate 13 located in the chamber 51. A head of the elastic plate 13 is located above the male terminal entrance 52. The elastic plate 13 and another side wall of the chamber 51 are constructed as a holding portion 53. The male terminal 20 is installed on and connected to the drive board 40. For the convenience of installing, the male terminal 20 can be equipped with a male housing 60. The male housing 60 is installed on the drive board 40 through at least one convex cylinder 61. The male terminal 20 penetrates through the male housing 60. One end of the male terminal 20 is connected to the drive board 40 electrically. Another end of the male terminal 20 penetrates through the male terminal entrance 52 and inserts into the holding portion 53 to be in contact with the elastic plate 13 and simultaneously press the contact head 14 to allow the contact head 14 to rest against the mounting base 11.

Regarding the LED lamp, the simple female terminal 10 is divided into a positive female terminal and a negative female terminal. The male terminal 20 is divided into a positive male terminal and a negative male terminal. If both of the positive female terminal and the negative female terminal are installed on the female housing 50, the female housing 50 forms two chambers 51 where the positive female terminal and the negative female terminal of the simple female terminal 10 are installed. A baffle plate 54 is formed between the chambers 51. The positive male terminal and the negative male terminal of the male terminal 20 are respectively inserted into the chambers 51. One side of the positive male terminal and one side of the negative male terminal are in contact with the elastic plates 13 respectively, and another side of the positive male terminal and another side of the negative male terminal are in contact with sides of the baffle plate 54.

The simple female terminal 10 of this invention is applied to an LED lamp. The LED lamp has a lamp cap 70, a light board 40, a drive board 30, a lamp holder 80, and a lamp base 90. The lamp cap 70 is installed on the lamp holder 80. The light board 40 is installed in the lamp cap 70. The drive board 30 is installed in the lamp holder 80. The light board 40 is located above the drive board 30. The lamp base 90 is installed on the lamp holder 80. The LED lamp connector has a female housing 50 installed through a through hole 41 of the light board 40 and a simple female terminal 10 installed in the female housing 50. The simple female terminal 10 has a weld leg 12 which provides the electrical connection with the light board 40. The male terminal 20 (by directly welding or through the male housing 60) is installed on the drive board 30. The male terminal 20 passes through a male terminal entrance 52 of the female housing 50 to be in contact with the elastic plate 13, thereby achieving the electrical connection between the light board 40 and the drive board 30.

While the embodiments of this invention are shown and described, it is understood that further variations and modifications may be made without departing from the scope of this invention.

What is claimed is:

1. A simple female terminal comprising a mounting base, a weld leg, and an elastic plate, one end of said mounting base bending to form said weld leg, another end of said mounting base bending to form said elastic plate, a head of said elastic plate bending toward said mounting base to form a contact head, when a male terminal comes into contact with said elastic plate, said male terminal presses said contact head to allow said contact head to rest against said mounting base.

2. The simple female terminal as claimed in claim 1, wherein said mounting base has a horizontal plate and a vertical plate, one end of said horizontal plate bending inclinedly and downwards and further bending horizontally to form said weld leg, another end of said horizontal plate connecting with an upper end of said vertical plate, a lower end of said vertical plate bending inclinedly and upwards and further bending toward said vertical plate to form said contact head which is in an arched shape.

3. A simple LED lamp connector for a drive board and a light board comprising at least one simple female terminal as claimed in claim 1, a female housing, and at least one male terminal, said female housing being installed on said light board and provided with at least one chamber, a bottom of said chamber forming a male terminal entrance, said simple female terminal being installed on said female housing, said simple female terminal having a mounting base disposed at a side wall of said chamber, a weld leg located out of said chamber to connect with said light board, and an elastic plate located in said chamber, a head of said elastic plate being located above said male terminal entrance, said elastic plate and another side wall of said chamber being constructed as a holding portion, said male terminal being installed on and connected to a drive board, said male terminal penetrating through said male terminal entrance and inserting into said holding portion to provide a contact with said elastic plate and press a contact head of said elastic plate to allow said contact head to rest against said mounting base.

4. The simple LED lamp connector for the drive board and the light board as claimed in claim 3, wherein a barb is formed on a side of said mounting base to provide an engagement with said side wall of said chamber.

5. The simple LED lamp connector for the drive board and the light board as claimed in claim 3, wherein said female terminal is divided into a positive female terminal and a negative female terminal, said male terminal being divided into a positive male terminal and a negative male terminal, said female housing forming two chambers where said positive female terminal and said negative female terminal are installed, a baffle plate being formed between said two chambers, said positive male terminal and said negative male terminal being respectively inserted into said two chambers, one side of said positive male terminal and one side of said negative male terminal being in contact with said two elastic plates respectively, and another side of said positive male terminal and another side of said negative male terminal being in contact with sides of said baffle plate.

6. The simple LED lamp connector for the drive board and the light board as claimed in claim 3, wherein said male terminal is equipped with a male housing, said male housing being installed on said drive board, said male terminal penetrating through said male housing, one end of said male terminal being connected to said drive board, another end of said male terminal penetrating through said male terminal entrance to be in contact with said elastic plate.

7. An LED lamp comprising a lamp cap, a light board, a drive board, a lamp holder, and a lamp base, said lamp cap being installed on said lamp holder, said light board being installed in said lamp cap, said drive board being installed in said lamp holder, said light board being located above said drive board, said lamp base being installed on said lamp holder, characterised in that the simple LED lamp connector as claimed in claim 3 is installed between said light board and said drive board, said LED lamp connector having a female housing installed through a through hole of said light board and at least one simple female terminal installed in said female housing, said simple female terminal having a weld leg which is electrically connected to said light board, a male terminal being installed on said drive board, said male terminal passing through a male terminal entrance of said female housing to be in contact with said elastic plate, thereby achieving an electrical connection between said light board and said drive board.

* * * * *